US005230175A

United States Patent [19]

Follis

[11] Patent Number: 5,230,175

[45] Date of Patent: Jul. 27, 1993

[54] MULTIFACETED MODULAR SIGN SYSTEM AND COMPONENTS

[76] Inventor: John V. Follis, 1844 Mar Vista, Pasadena, Calif. 91104

[21] Appl. No.: 685,147

[22] Filed: Apr. 15, 1991

[51] Int. Cl.[5] ..... G09F 7/00

[52] U.S. Cl. ..... 40/605; 40/622

[58] Field of Search ..... 40/489, 491, 605, 618, 40/620, 622, 486

[56] References Cited

U.S. PATENT DOCUMENTS

| | | | |
|---|---|---|---|
| 528,196 | 10/1894 | Webster | 40/622 |
| 666,024 | 1/1901 | Rankin | 40/491 X |
| 3,358,395 | 12/1967 | Simonovic | 40/489 |
| 3,419,979 | 1/1969 | Medlicker et al. | 40/618 |
| 4,505,061 | 3/1985 | Neuburger et al. | 40/605 X |
| 4,543,759 | 10/1985 | Rohrer | 40/605 X |
| 4,729,184 | 3/1988 | Cihanek | 40/486 X |
| 5,027,540 | 7/1991 | Schwarz | 40/491 X |

FOREIGN PATENT DOCUMENTS

| | | | |
|---|---|---|---|
| 354488 | 2/1990 | European Pat. Off. | 40/605 |

*Primary Examiner*—Kenneth J. Dorner
*Assistant Examiner*—J. Bonifanti
*Attorney, Agent, or Firm*—William W. Haefliger

[57] ABSTRACT

A modular sign system, having modular units, each comprising a back frame having a thin backplate and a thin wall upstanding from the backplate and bounding a recess formed in front of the backplate; support posts outstanding from and integral with the backplate at spaced locations in the recess, and one of the following:

i) a faceplate received over the recess and supported on and by the posts, the faceplate having a bounding edge which is closely bounded by the wall, ii) a faceplate received on and supported by the wall, substantially to close the recess, the faceplate adapted to carry sign information, and the backplate adapted to be carried adjacent a supporting surface.

Multiple such units may be combined to form a sign system, and alphanumeric elements may be carried on the faceplate or faceplates.

46 Claims, 17 Drawing Sheets

MULTIFACETED MODULAR SIGN SYSTEM AND COMPONENTS

BACKGROUND OF THE INVENTION

This invention relates generally to modular sign systems, and more particularly to improvements in such system facilitating assembly of modular units, supporting of such units on surfaces such as walls and in clustered relation, and provision of selected sign information on such units, as for example alphanumeric characters.

There is need for informational modular sign systems usable as for example for architectural purposes, and readily installable during interior redesign, or design, of offices, open work stations, hospitals, hotels, or other spaces. There is also need for modular sign systems which will facilitate use and installation of many different faceplates, such as plates with selected data thereon, to be informationally displaced, and in different color and shape combinations.

Faceplates of different configurations and combinable in different ways are also desirable. Further, means to readily support such sign systems on fabric-covered walls are also needed.

SUMMARY OF THE INVENTION

It is a major object of the invention to provide a modular sign system meeting the above needs. Basically, the improved modular unit of the invention comprises:

a) a back frame having a thin backplate and a thin wall outstanding from the backplate and bounding a recess formed in front of the backplate, b) support posts outstanding relative to the backplate at spaced locations in the recess, the posts having lesser overall height than the wall, c) and one of the following:

i) a faceplate received over the recess and supported on and by the posts, the faceplate having a bounding edge which is closely bounded by the wall, ii) a faceplate received on and supported by the wall, substantially to close the recess, the faceplate adapted to carry sign information, and the backplate adapted to be carried adjacent a supporting surface.

As will appear, multiple of such units may be selected and installed in clustered relation, as for example with their bounding walls assembled in adjacent relation, to provide a sign system, the faceplates then extending in a selected, viewable relation to display the selected data, such as alphanumeric characters, on the faceplates.

Another object is to provide such modular units in different configurations, such as rectangles, squares, circles, semi-circles, quarter circles, etc., for assembly into different overall sign configurations.

It is another object of the invention to provide the unit wall to have uniform height and to be upstanding from the periphery of the backplate; also, the posts may have uniform height and are dispensed within the recess.

Another object is to provide means on the backplate to attach the backplate and back frame to a support with penetration of the support; and such means may advantageously include a support element forming an annular groove, and a spring wire recessed in the groove and held therein by spring tension, the wire defining a pin which extends generally parallel to the backplate but projects away from the backplate for penetration into the support. The wire typically extends in a loop and is held in hoop tension in the groove, whereby a very flat attachment is provided for pin penetration into a fabric wall to support the unit on that wall.

These and other objects and advantages of the invention, as well as the details of an illustrative embodiment, will be more fully understood from the following specification and drawings, in which:

DRAWING DESCRIPTION

Figure 1:
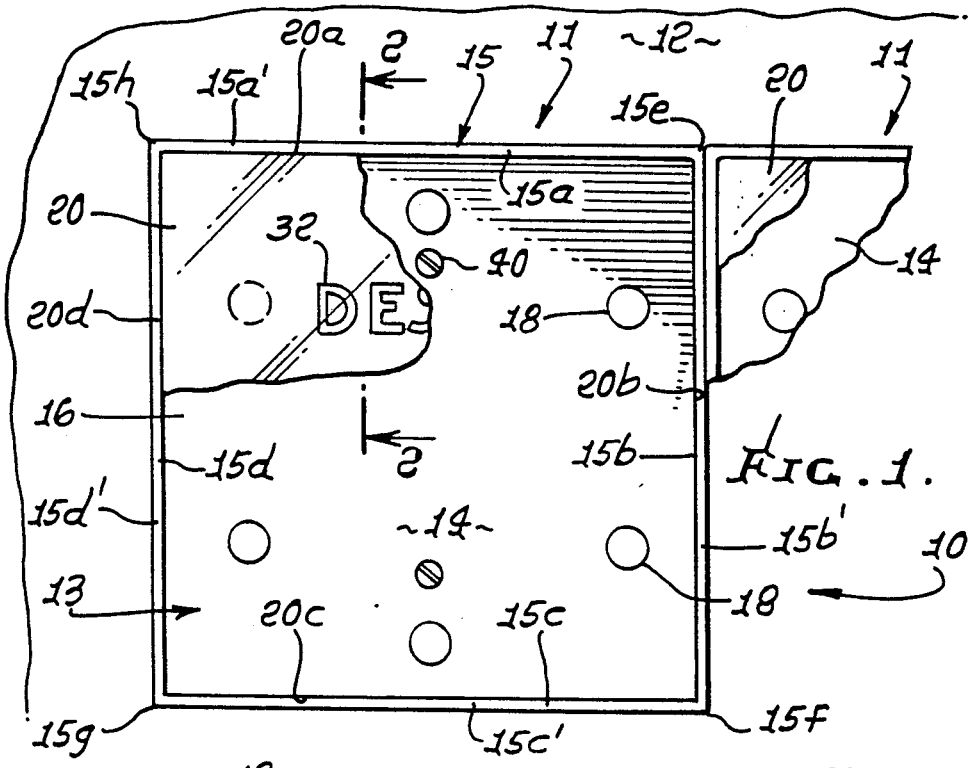
FIG. 1 is a frontal view, partly broken away, showing two modular units, in side-by-side, installed relation.
Figure 2:
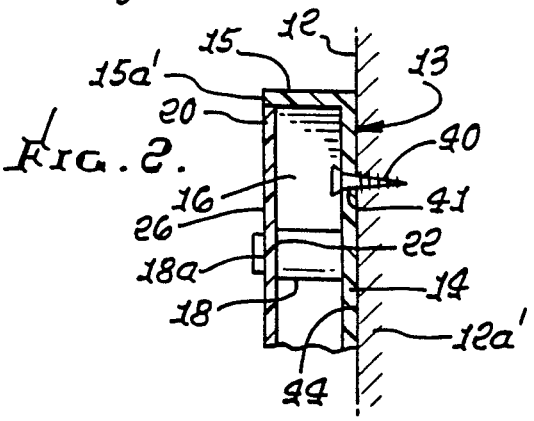
FIG. 2 is a section taken on lines 2—2 of FIG. 1.
Figure 3:
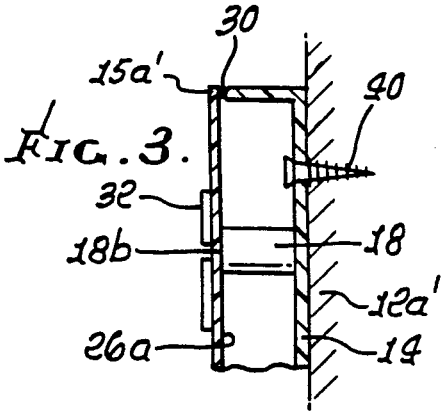
FIG. 3 is a view like FIG. 2 showing a modification.
Figure 3A:
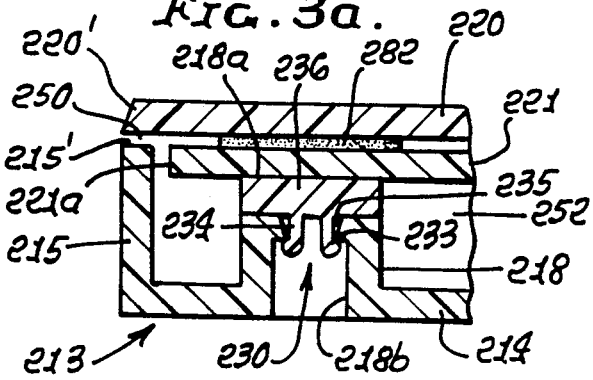
Figure 3B:
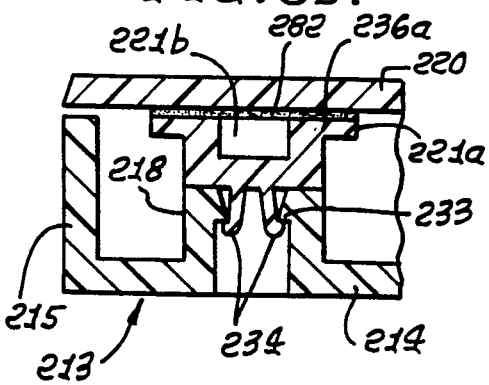
Figure 4:
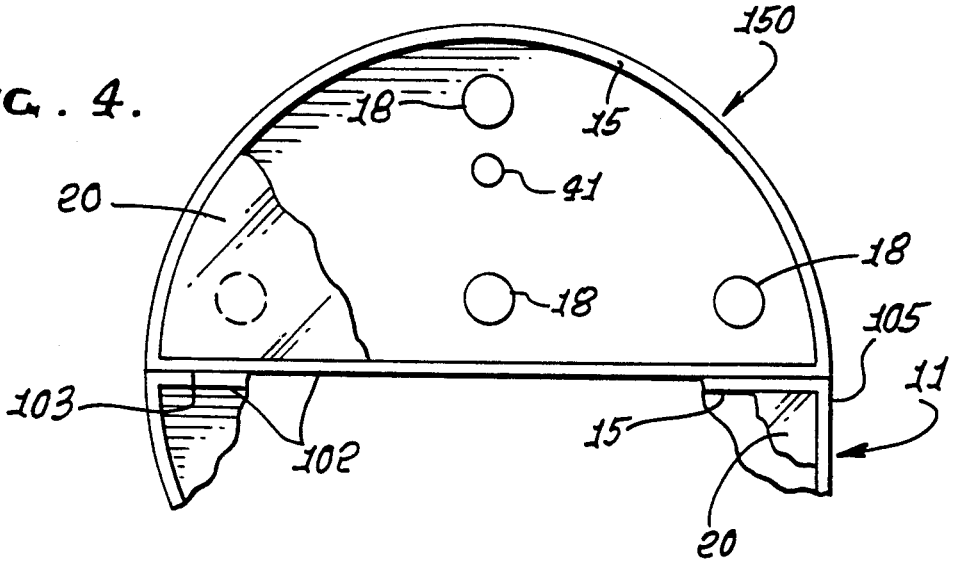
Figure 5:
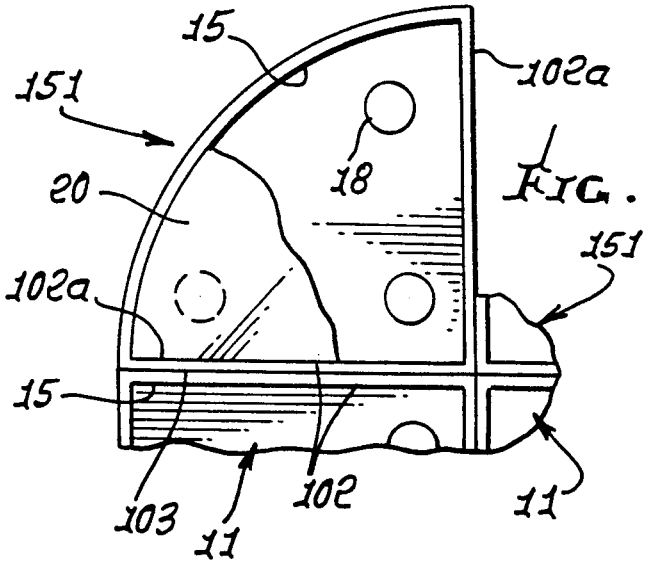
Figure 6:
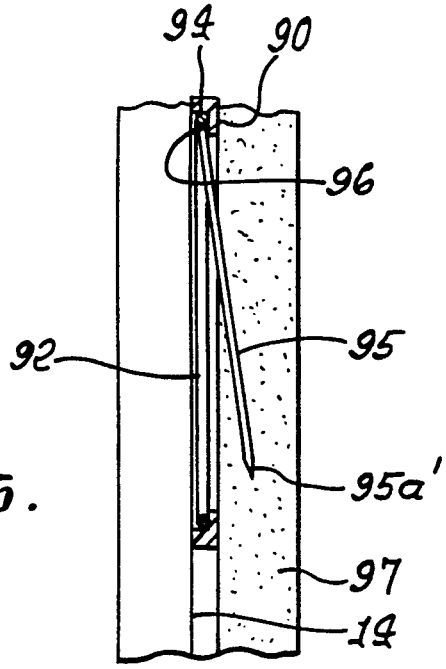
Figure 7:
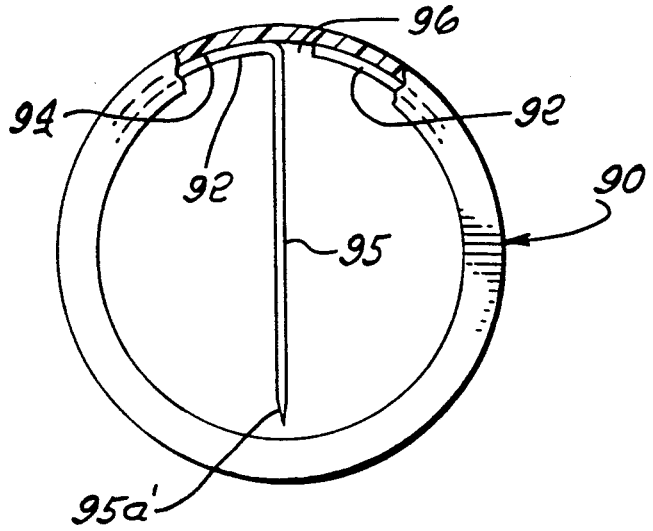
Figure 8:
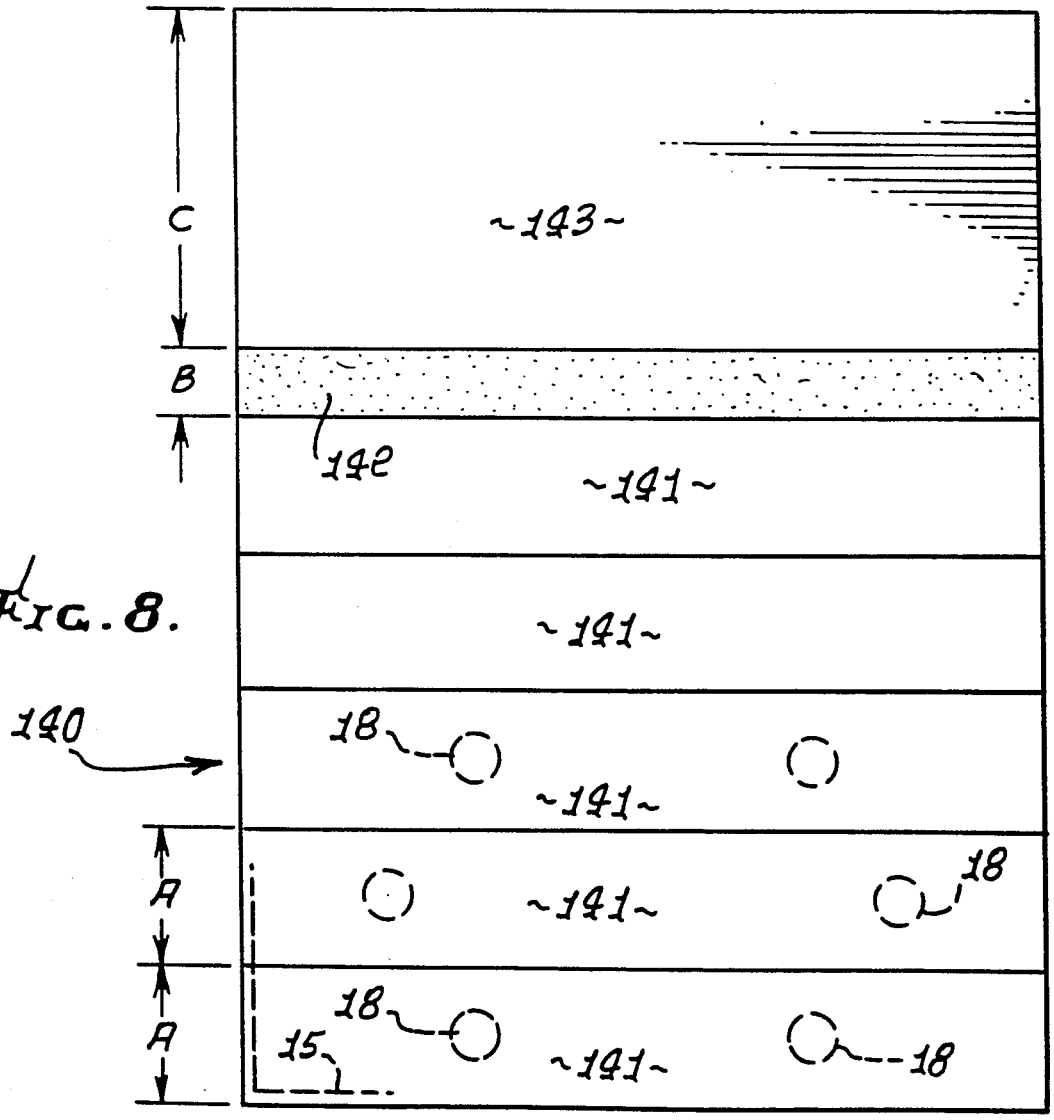
Figure 9:
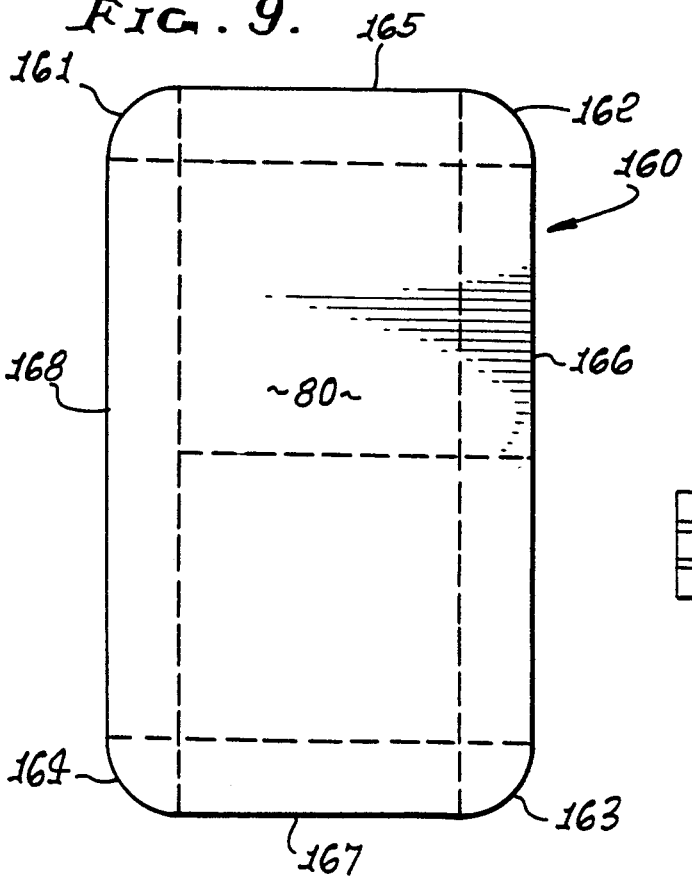
Figure 10A:
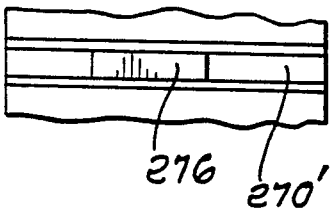
Figure 10:
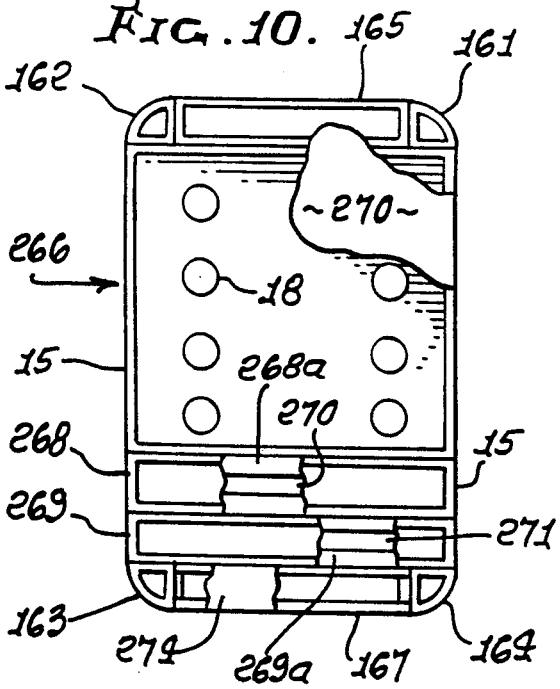
Figure 10B:
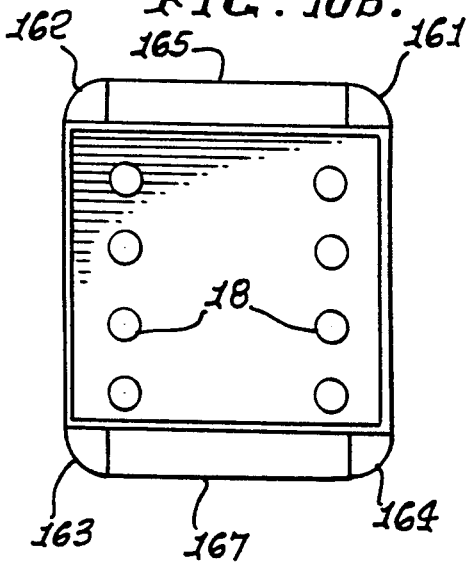
Figure 11:
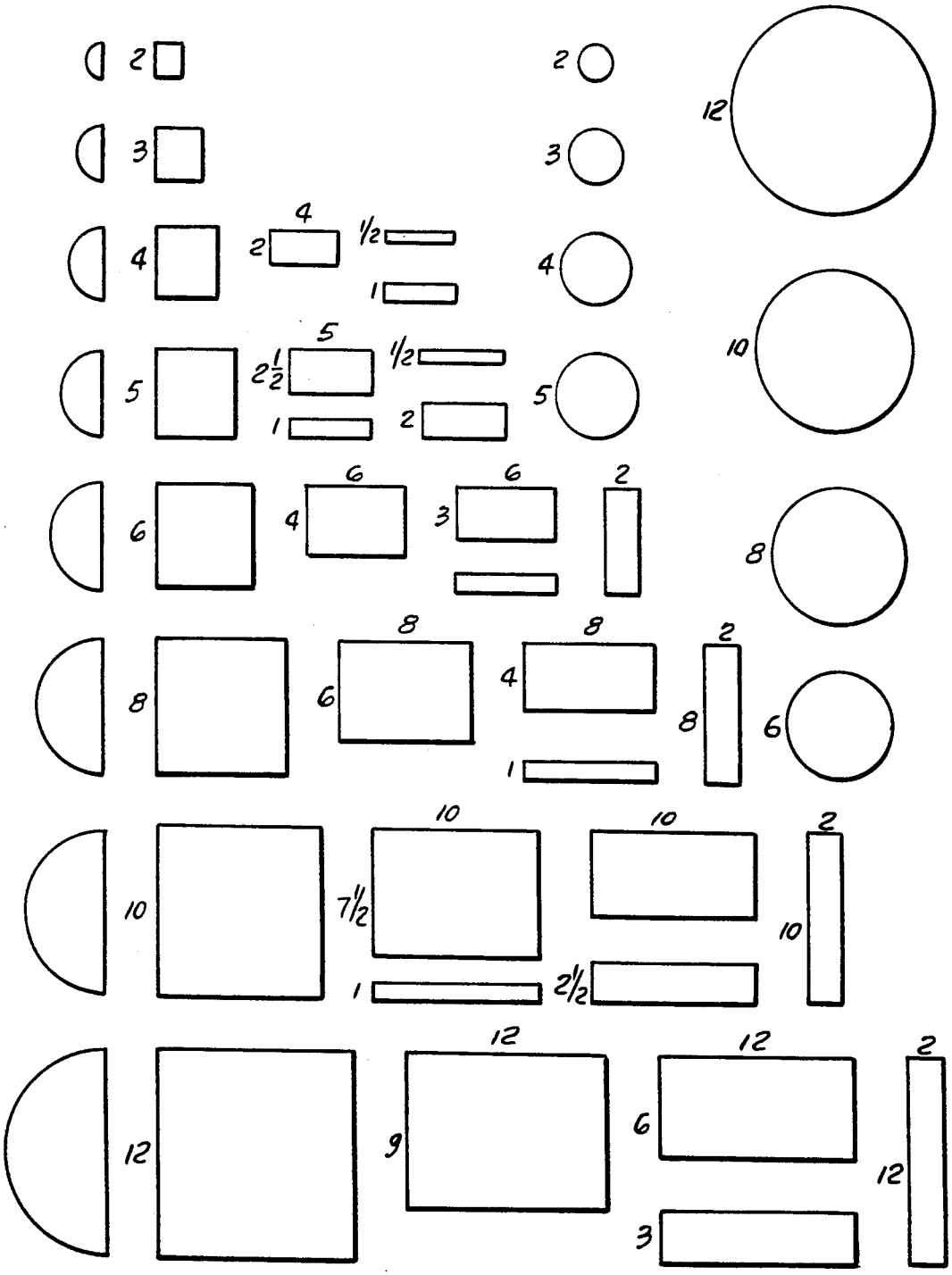
Figure 12:
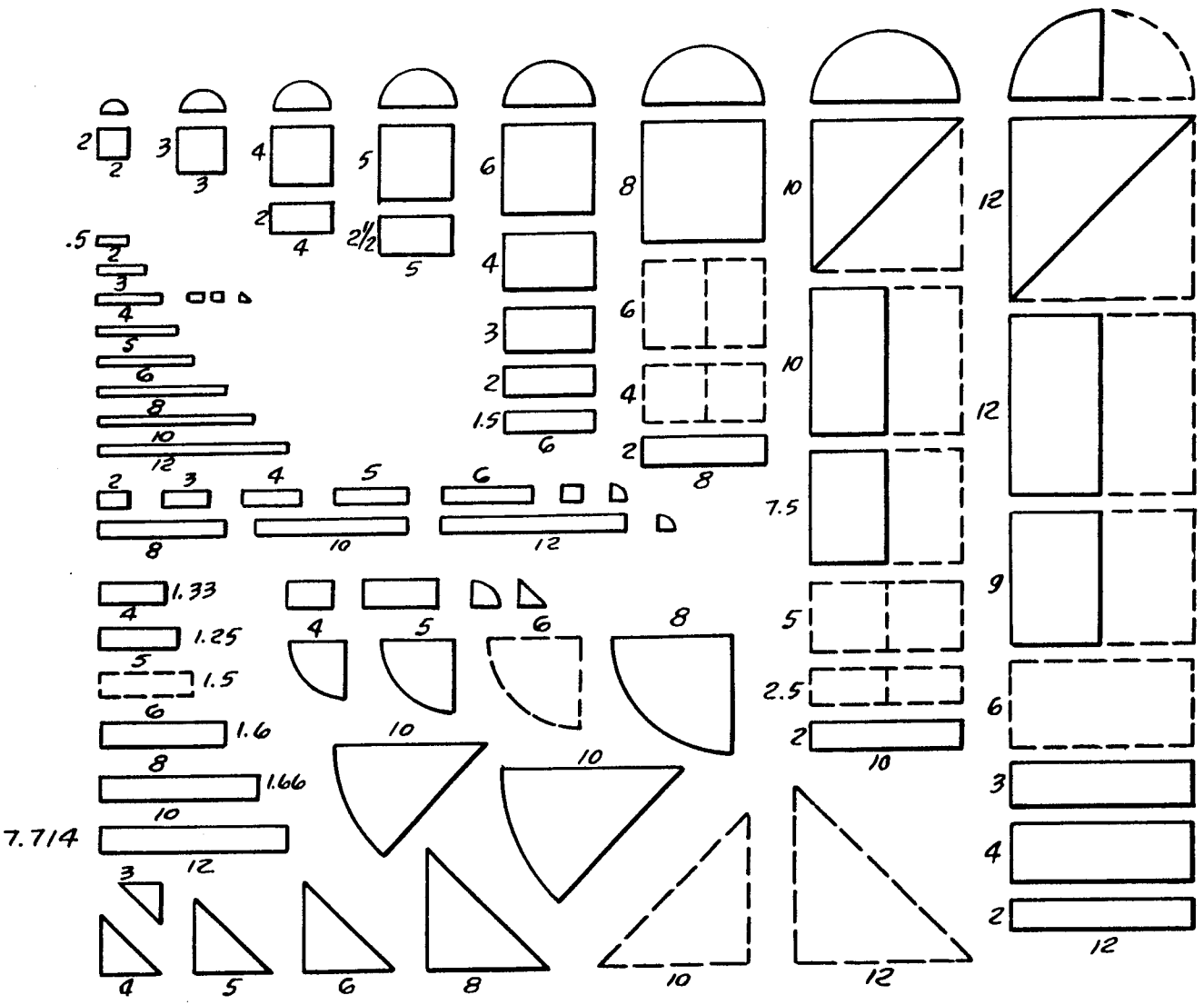
Figure 13A:
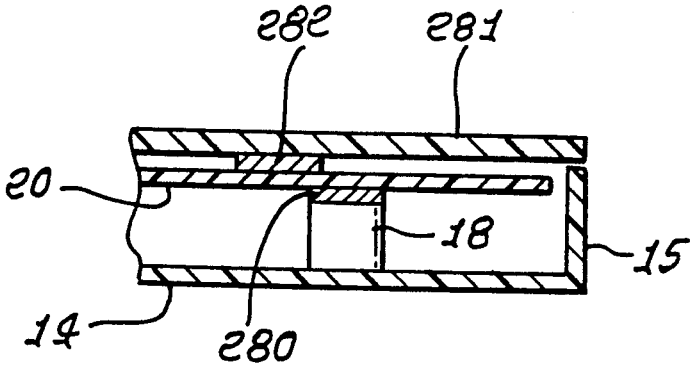
Figure 13B:
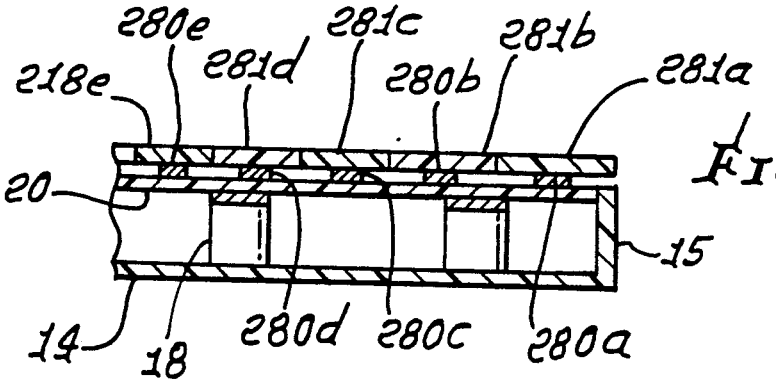
Figure 13C:
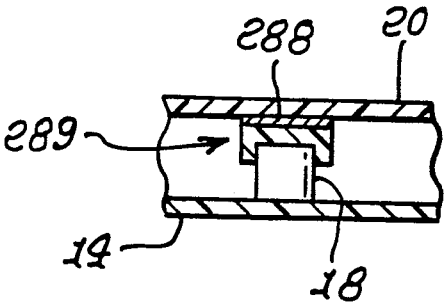
Figure 13D:
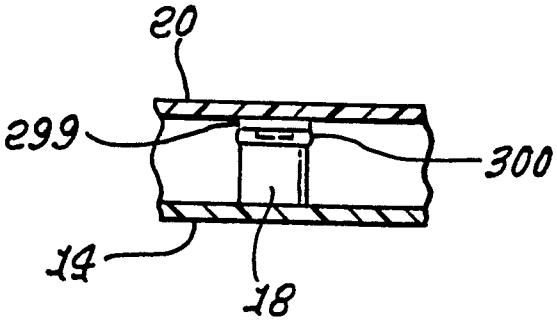
Figure 14:
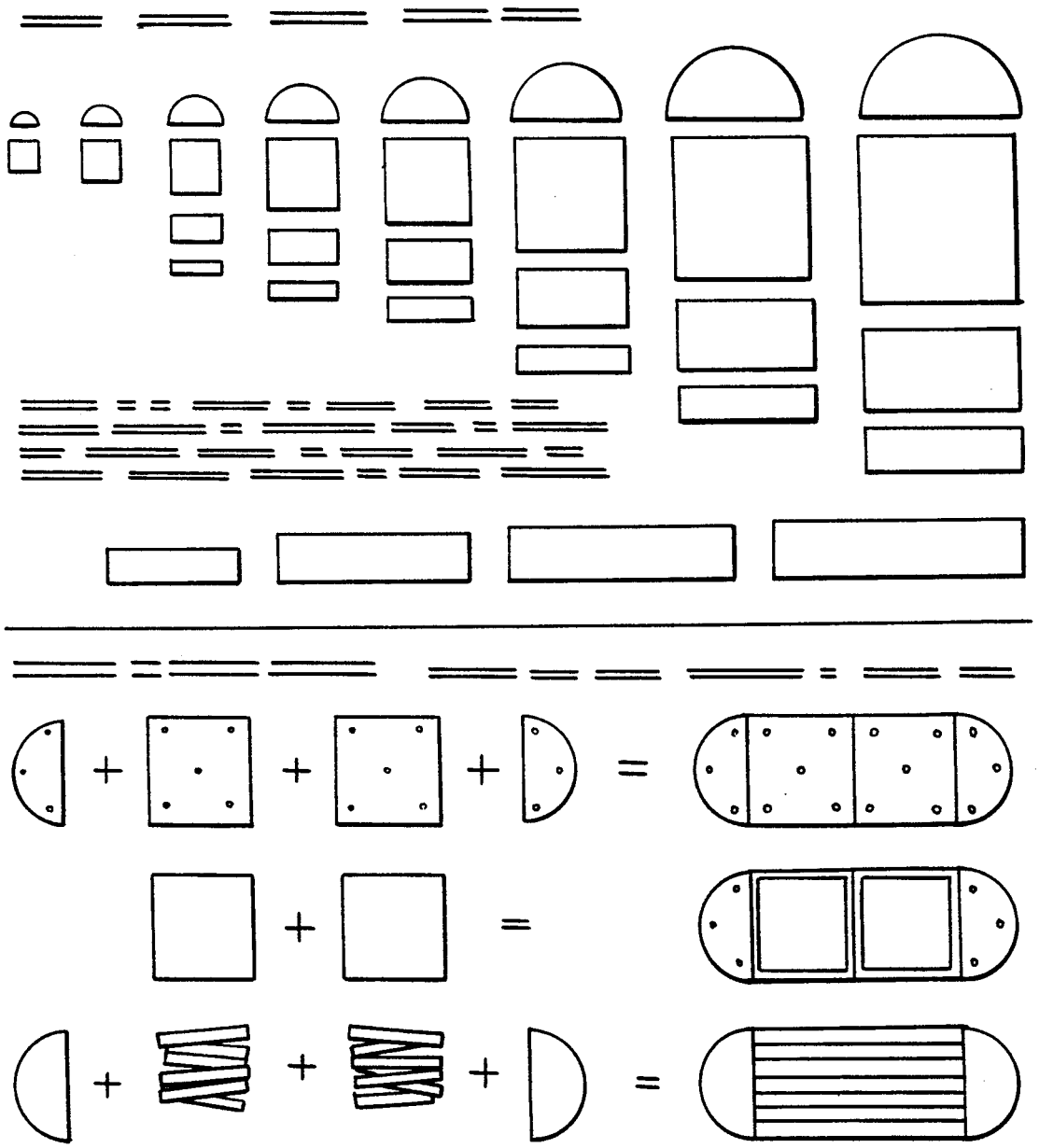
Figure 15:
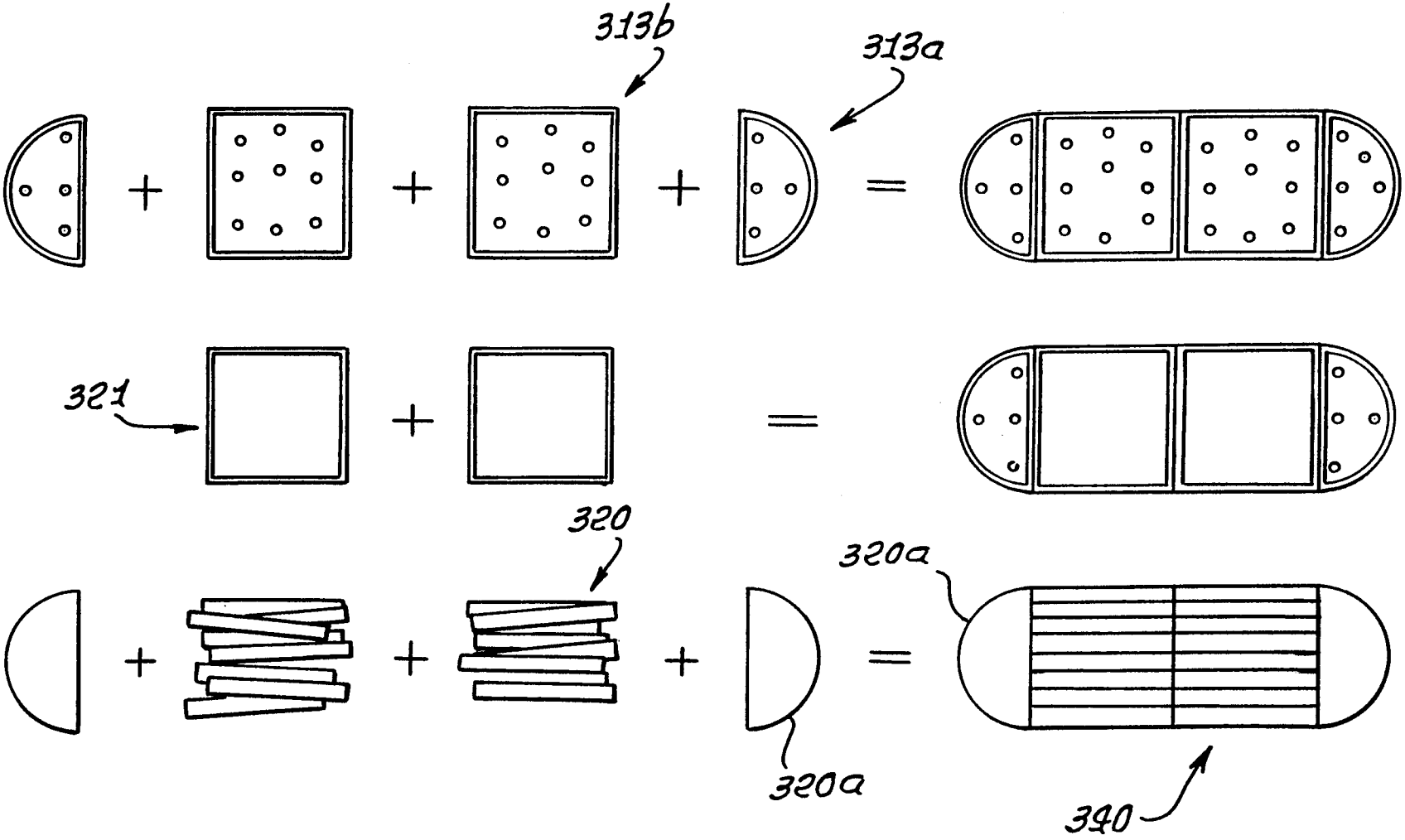
Figure 16:
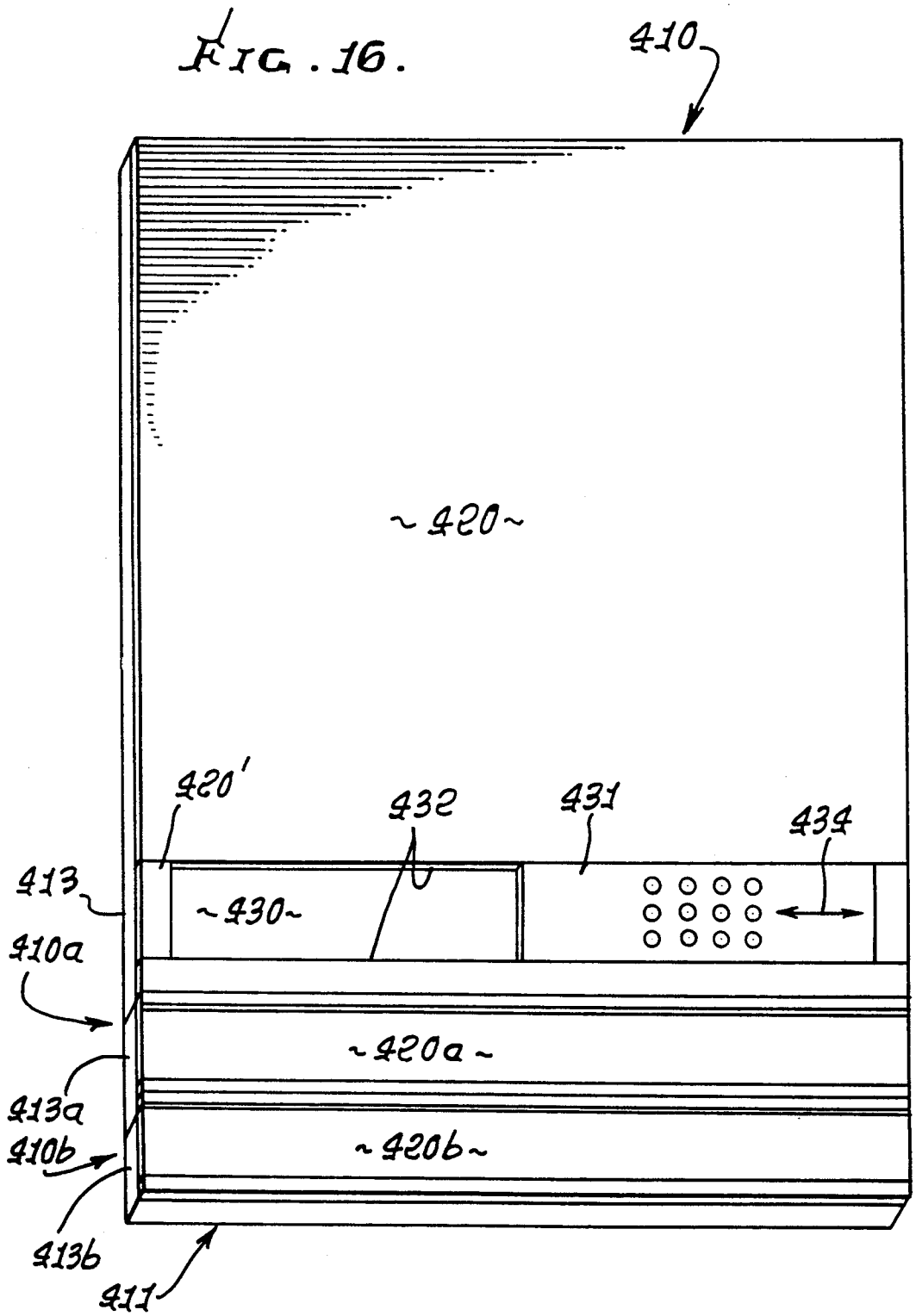
Figure 17:
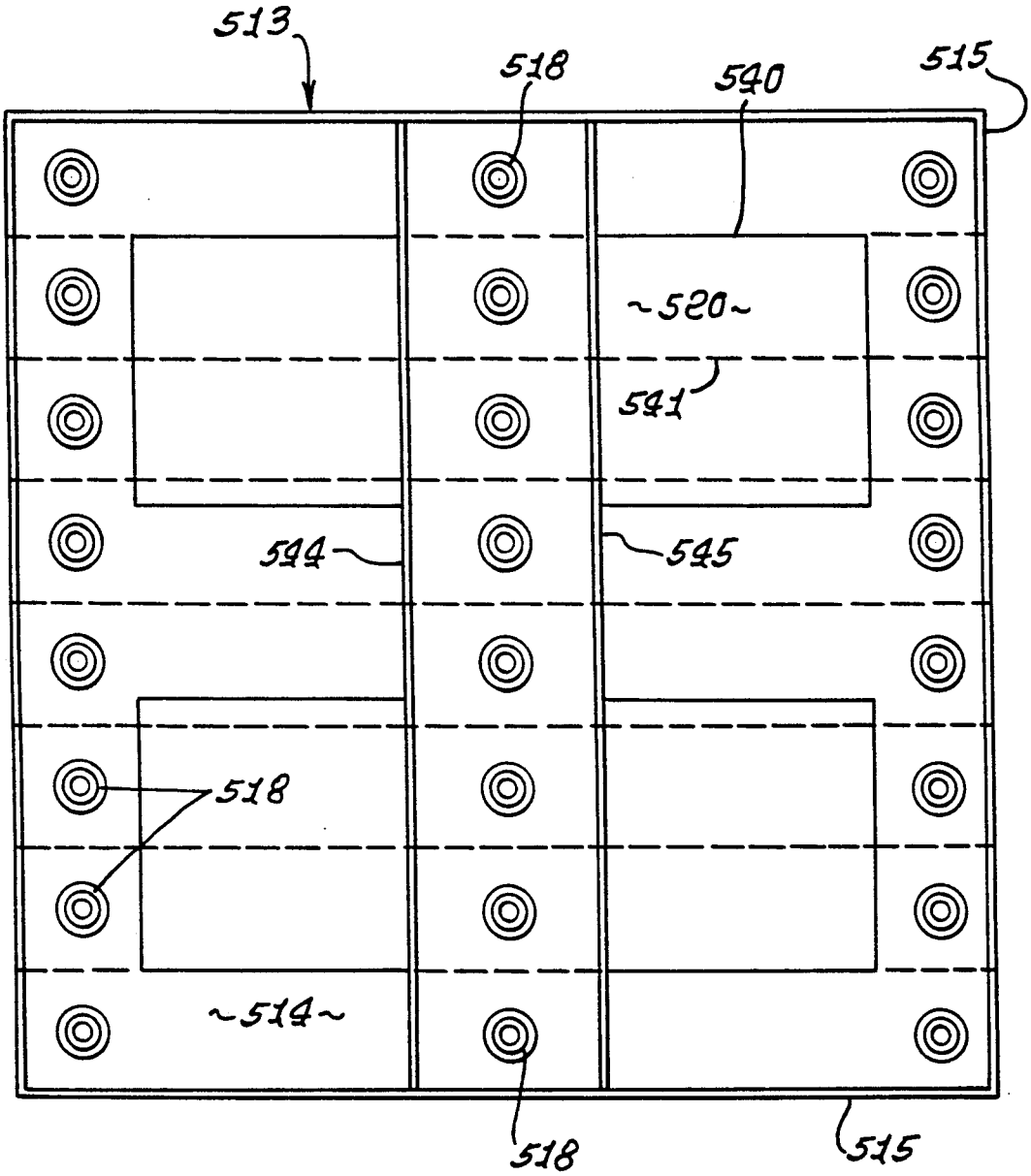
Figure 18:
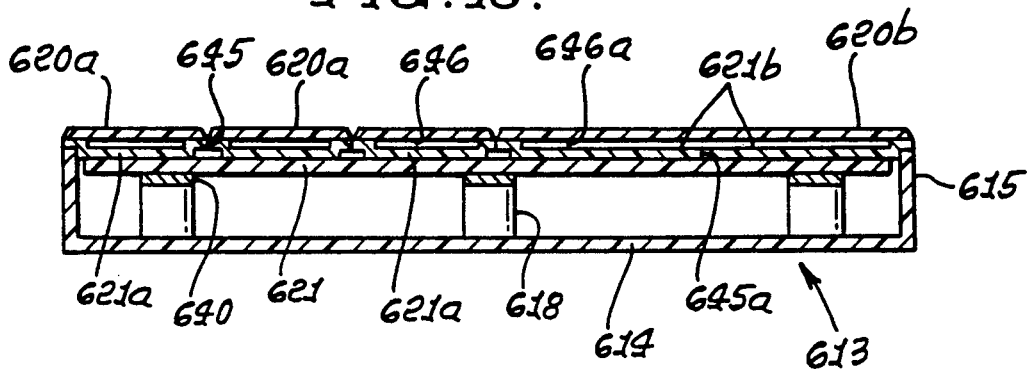
Figure 19:
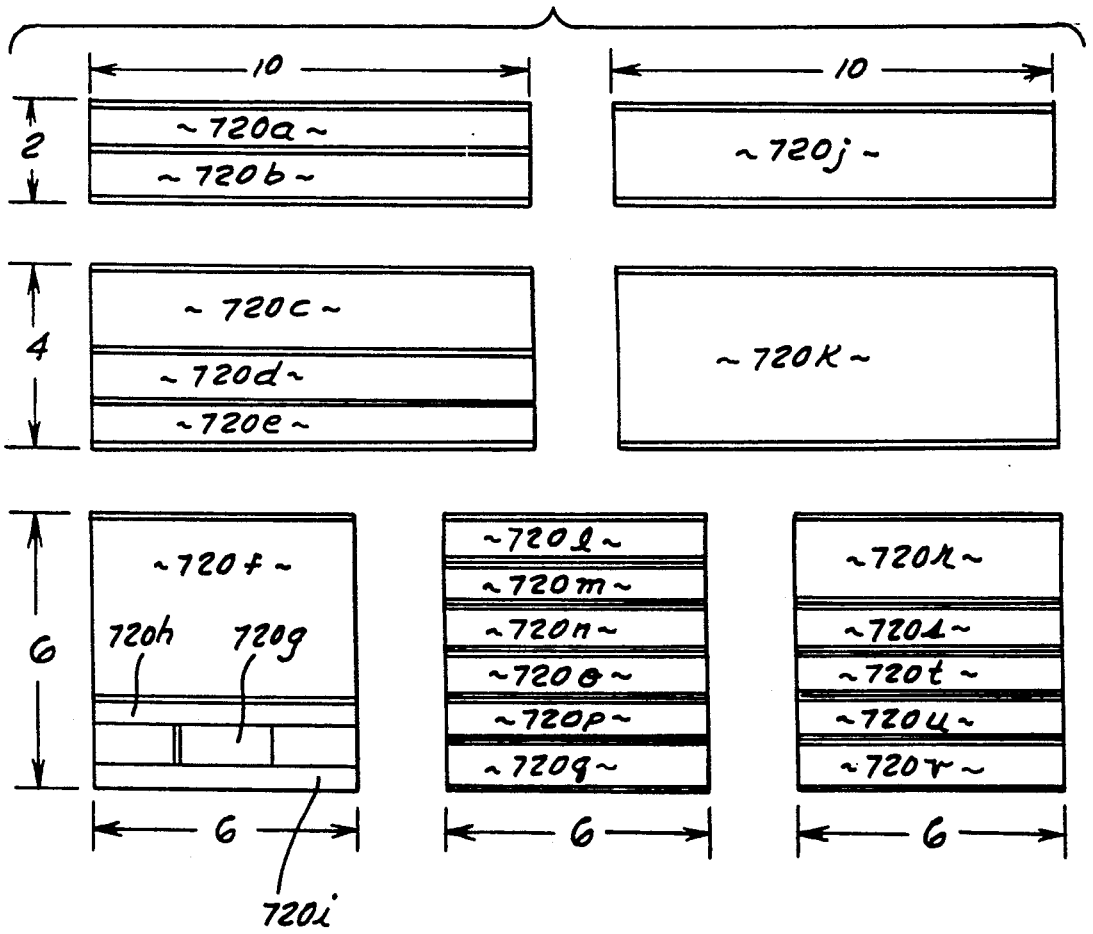
Figure 20:
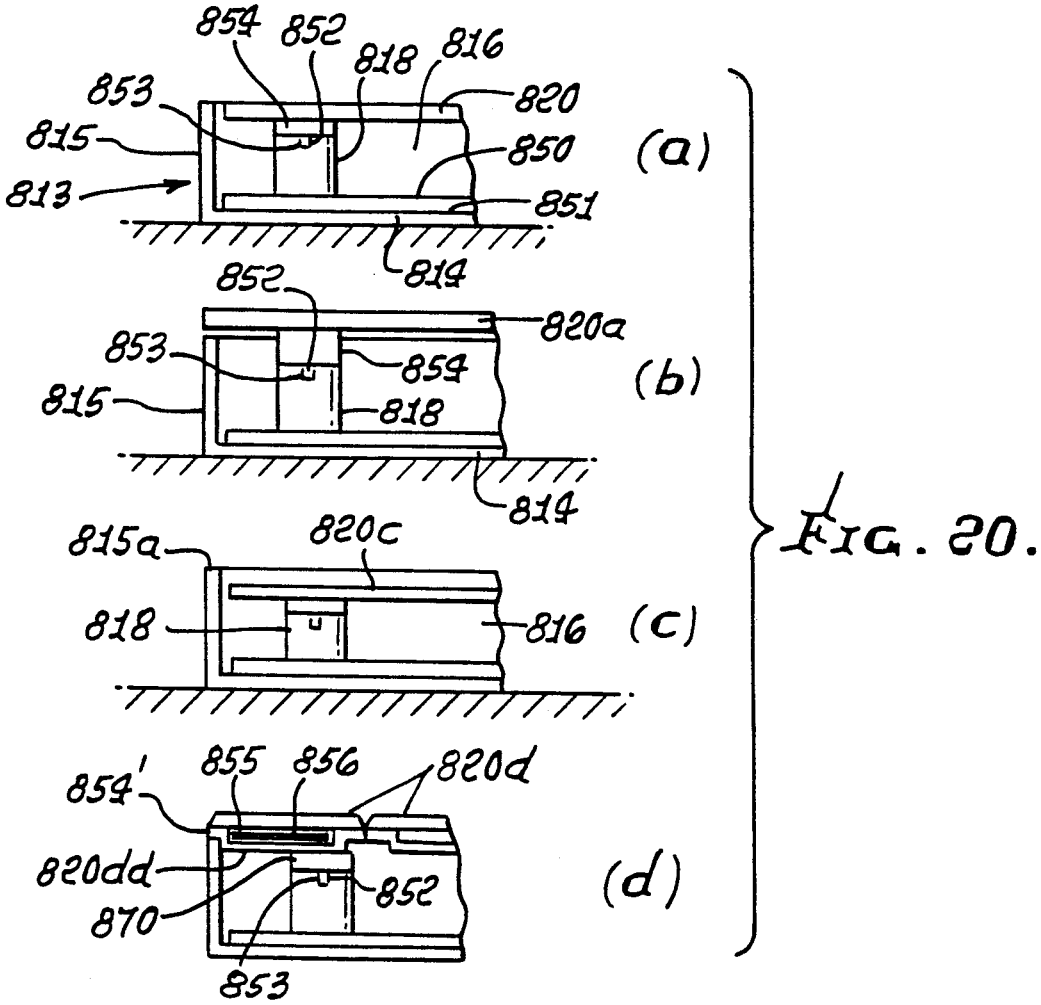
Figure 21:
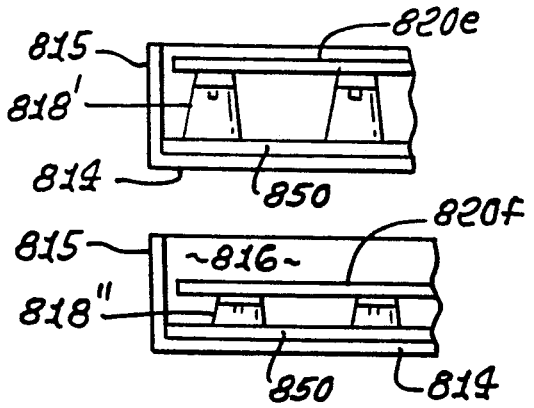
Figure 22:
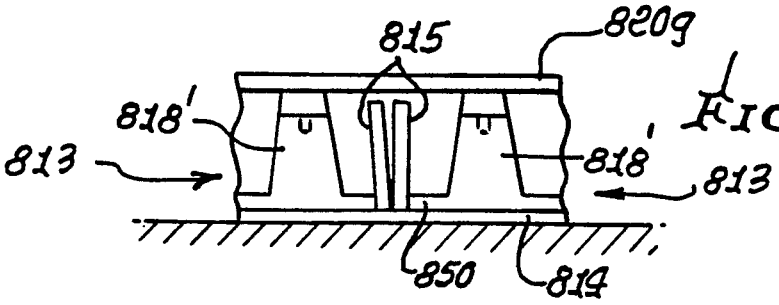
Figure 23:
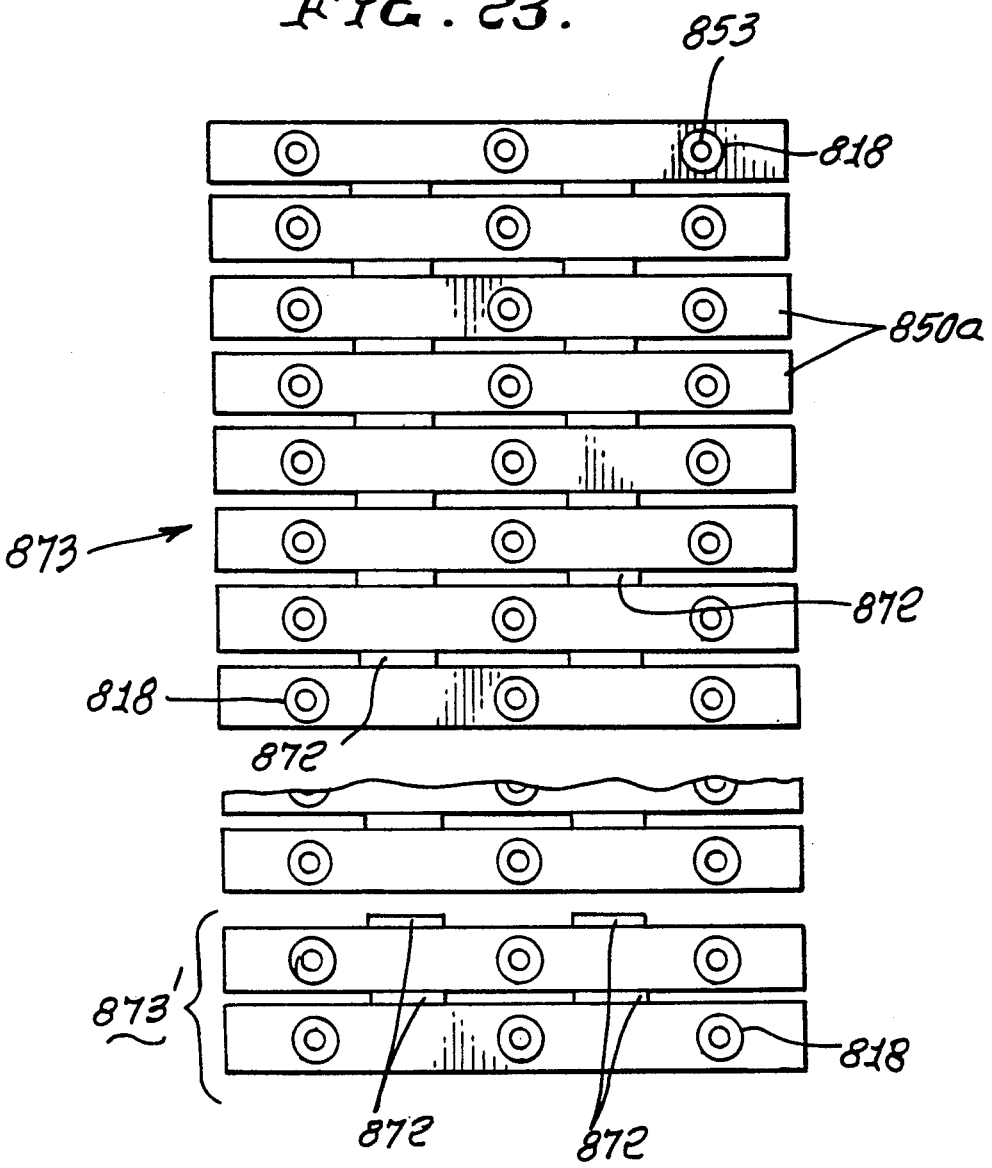
Figure 24:
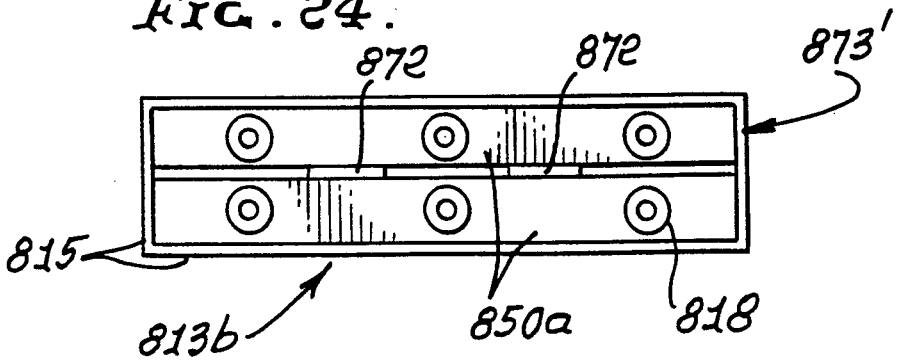
Figure 25:
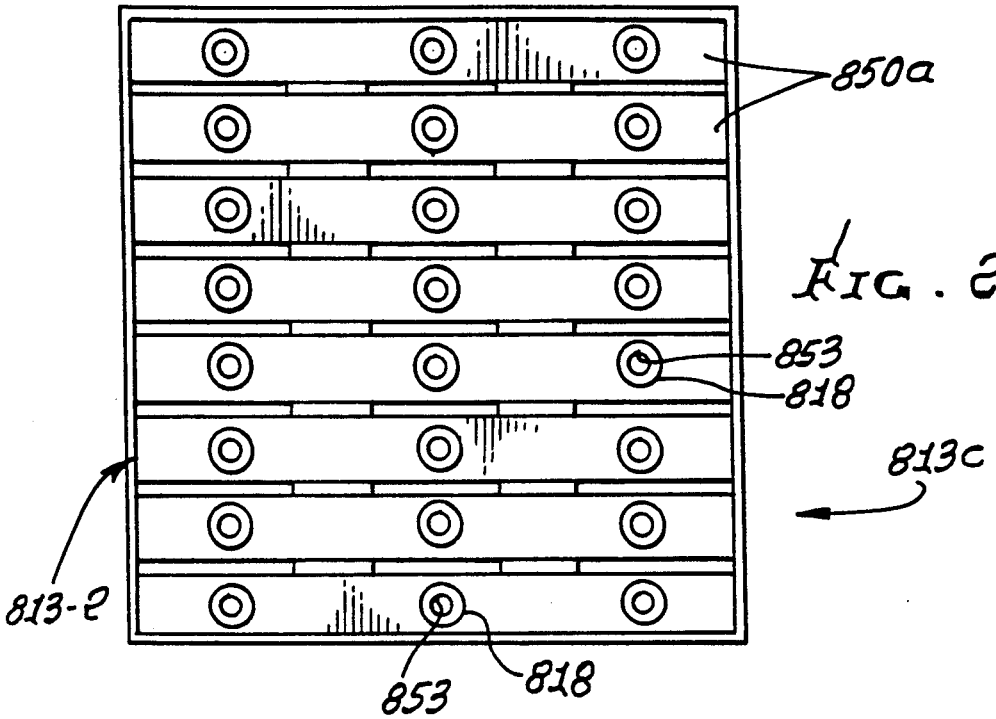
Figure 33:
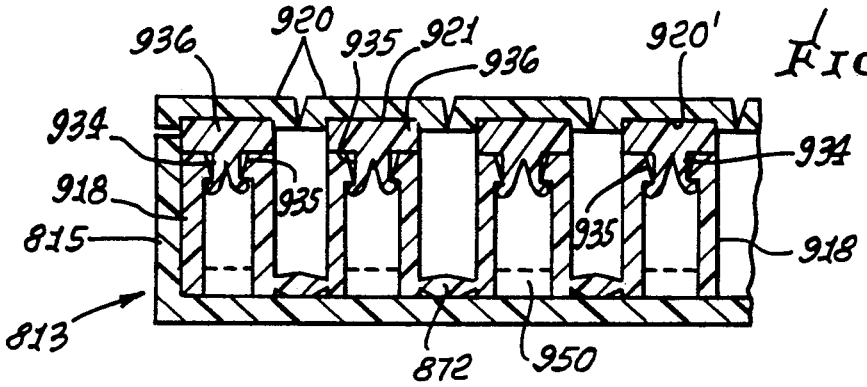
Figure 34:
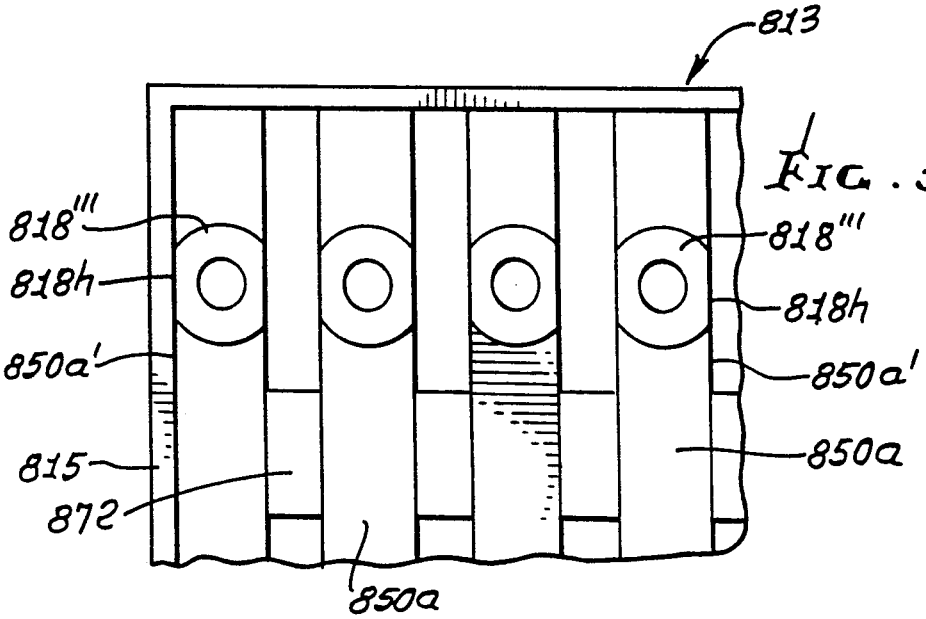
Figure 35:
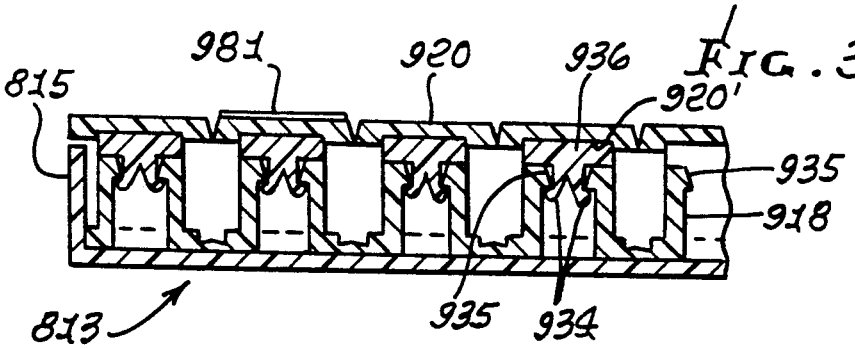
Figure 36:
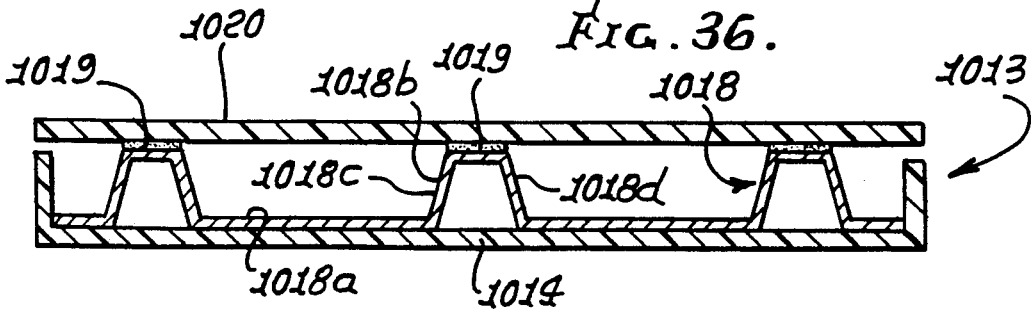

FIGS. 3*a* and 3*b* are sections showing further modifications;

FIGS. 4 and 5 are views like FIG. 6 showing different configuration units of the same internal construction as in FIG. 1;

FIG. 6 is a side elevation, partly in section, showing a modified means to hang or support a unit like FIGS. 1–3 on a pin-penetrable wall;

FIG. 7 is a frontal view of the FIG. 6 support means;

FIG. 8 is a frontal view of a unit like that of FIG. 1 showing a modification;

FIG. 9 is a frontal elevation of a unit like that of FIG. 1 showing another modification;

FIG. 10 is a frontal elevation of a unit like that of FIG. 6 showing a further modification; and FIGS. 10*a* and 10*b* are views like FIG. 10 showing further modifications;

FIG. 11 is a representation of different forms of unit faceplates with various configurations;

FIG. 12 is a representation of different forms of unit back frames with various configurations;

FIGS. 13*a*14 13*d* are fragmentary sections showing different attachments to posts;

FIG. 14 shows different and representative backplate assemblies;

FIG. 15 is a diagram showing assembly steps to form a sign;

FIG. 16 is a perspective view of a sign with window modules;

FIG. 17 is a plan view of a back frame and the interior thereof showing post arrangements;

FIG. 18 is a section through a sign structure;

FIG. 19 shows different signs and faceplate configurations;

FIG. 20 shows a modification employing auxiliary plates that support posts;

FIG. 21 shows modifications having tapered ports;

FIG. 22 shows a modification wherein a faceplate overlies multiple backframes;

FIGS. 23 and 24 show modified sub-plates;

FIGS. 25–28 show modified sub-plates in backframes;

FIGS. 29–32 show modified faceplates to attach to the FIGS. 25–29 plates;

FIG. 33 is a section showing faceplate sections snap connected to posts on modified sub-plates;

FIG. 34 is a plan view showing enlarged posts on modified sub-plares;

FIG. 35 is a section like FIG. 33 showing maination on faceplate sections; and FIG. 36 is a section showing a further modification.

DETAILED DESCRIPTION

In FIG. 1, the system 10 includes two modular sign units 11, each like the other, the two extending in side-by-side relation and supported on a wall or other surface 12. Each unit includes a back frame 13 having a thin, vertical backplate 14, and a thin, wall 15 outstanding (horizontally) from the backplate. Wall 15 bounds a recess 16 formed in front of the backplate, and the wall 15 may for example have four sections 15*a*–15*d* intersecting at corners 15*e*–15*h*, forming a substantially square configuration. The wall thickness is about 0.120 inch, for example, as is the backplate thickness; and the wall 15 and backplate 14 may be molded as a u it from synthetic resin (plastic) material such as ABS resin.

Support posts or columns 18 are outstanding from and integral with the backplate at spaced locations in the recess 16, as shown. They are dispersed throughout the recess to engage and support the rear side of a faceplate 20, which is separate from the integral components 14, 15 and 18.

After installation of the unit, as on wall 12, the faceplate may be attached to the posts, as at bond locations 22, to extend parallel to backplate 14, enclosing the recess 16. Faceplate 20 may be opaque or transparent, and typically consists of molded plastic material, the same as 14, 15 components, which are part of the back frame 13. The faceplate has thickness of about 1/16 inch, and has edges 20*a*–20*d* respectively parallel to wall sections 15*a*–15*d*, as referred to above.

In the form of the unit as seen in FIGS. 1 and 2, the faceplate 20 is received in the recess 16, and its edges closely fit the rims of wall sections 15*a*–15*d*, for closing the recess 16. The outer side 26 of the faceplate 20 is flush with the outer rims 15*a*′–15*d*′ of the wall sections, as is clear from FIG. 2.

The rear side of the faceplate is bonded to post surfaces 18*a*.

In FIG. 3, the posts 18 have outer surfaces 18*b* extending in the plane defined by the wall rims 15*a*′–15*d*′, so that the inner side 26*a* of the faceplate extends in or at that plane. The outer extent of the faceplate overhangs rims 15*a*′–15*d*′ and may be bonded thereto, as at 30, as shown. Side 26*a* is bonded to post surfaces 18*b*.

The faceplate is particularly well adapted to carry information or data, such as alphanumeric characters, shown at 32, for example cut vinyl letters, letters engraved in a laminated faceplate and letters having thickness. Such letters or numbers may be molded with the faceplate, or adhesively bonded thereto, at the front or outer surface 26 thereof, or otherwise emplaced. All parts (faceplate, back frame and posts) may consists of synthetic resin, such as ABS. The faceplate may be transparent and provide a window, as on a sign.

FIGS. 2 and 3 also show a holder, such as a screw 40, installed in the wall 12*a*′ and projecting outwardly for reception through an opening 41 in the backplate. Alternately, the backplate 14 can be bonded to the surface 12, as at 44. If multiple units are supported to the wall and in clusters, their backplates define a common plane, and their faceplates define another common plane for supporting alphanumeric characters in a common plane.

It is another feature of the invention that means may be provided on the backplate to attach the latter to a support, as by penetration of the support. In the example seen in FIGS. 6 and 7, such means includes a support element forming an annular groove, and a spring wire recessed in the groove and held therein by spring tension, the wire defining a pin which extends generally parallel to the backplate but projects away from the backplate for penetration into the support. As shown, a support element in the form of a hard, plastic ring 90 defines an annular groove 96 at its inner periphery. A loop-shaped, spring wire 92 is received in the groove, and seeks to expand, by hoop tension, so as to grip the groove wall 94. The wire has a freely projecting portion defining a pin 95, which extends generally parallel to the backplate and ring 90; however, the pin also is inclined rearwardly, and has a pointed tip 95*a*′ to penetrate the support wall 97. The latter may consist of penetrable material, such as wall (particle) board, or fabric, or fabric-type padding, attached to a wall or metal back. Thus, the modular sign unit is easily attached to a support wall. The ring 90 is rigidly attached to the rear side of the backplate, as shown.

FIGS. 4 and 5 show half round and quarter round sign units 150 and 151 of the same construction, as described in FIGS. 1 and 2. Two or more such units 150 may be placed edge-to-edge with adjacent straight walls 102 (corresponding to wall section 15). They may be bonded together at 103. A multi-unit, circular system is thereby formed. The adjacent units may have different colors for decorative purposes. Posts 18 are related to walls 15, as in FIGS. 1–3, as are faceplates 20.

In FIG. 3*a*, a plastic faceplate 220 extends over a back frame 213. The latter includes a rear or backplate 214 and a peripheral, outstanding wall 215 which may define any of various shapes, such as a square, rectangle, circle, semi-circle, triangle, etc. A slight gap 250 exists between the wall rim 215′ and the overhanging extent 220′ of plate 220. A plurality of spaced, like columns or posts 218 are integral with the back frame, as by connection to the backplate 214, as in FIGS. 1–3. The columns or posts project toward the faceplate, but each terminates at 218*a*, beneath or inwardly spaced from the plane defined by rim 215′. Thus, the ends of the columns or posts lie within the recess 252 defined by the back frame, and the plane defined by ends 218*a* is parallel to the plane defined by the rim 215′, and spaced therefrom.

Means is provided to connect the faceplate 220 to the columns 218, such means including a sub-plate 221 interposed between the faceplate and the column ends 218*a*, the sub-plate periphery 221*a* extending proximate, but spaced from, the inner side 215′ of wall 215. The sub-plate may be adhesively bonded to the faceplate, as by adhesive means, such as double-sided adhesive tape 282 at the inner side of the faceplate and at the outer side of the sub-plate, as shown. Additionally, the connection means includes multiple connectors between the sub-plate and the posts or columns, examples of such connectors indicated at 230.

In the example seen in FIG. 3*a*, the connectors include snap connection elements carried by the sub-plate, and also by the posts or columns. The posts 218 are hollow, such as cylindrical and define through bores 218*b*. The snap connection elements carried by the posts are shown to include ledges 233 facing away from plate 220, and spring fingers 234. At least two spring fingers are received in each post to cam against tapered post surfaces 235, causing the fingers to yieldably deflect toward one another, and then to spring or snap apart to the position shown, in interengaged relation with the ledges, preventing pull-out of the spring fingers from the posts. The spring fingers are shown as integral with caps 236 that seat on the posts, the caps fused to the sub-plate.

In FIG. 3*b*, the construction is the same, except that the modified cap 236*a* is integral with the sub-plate 221*a;* and the sub-plate is channel shaped to form a recess 221*b* which may be elongated along with the narrowed sub-plate in the direction perpendicular to the plane of FIG. 3*b*. The sub-plate may carry several caps and connector fingers spaced apart in that direction. Recess 221*b* may receive lettering or other indicia viewable through extents of transparent plate 220 directly exposed to the recess.

FIG. 4 alternatively shows the corner 105 of a square unit 11 of the construction, as described in FIGS. 1 and 2, that unit having a wall 15 placed adjacent wall 102, and bonded thereto, both walls having the same lengths.

FIG. 5 shows a sign unit (of the construction described) in the form of a quarter round (90°) section of a circle. Note also its use in conjunction with a square unit 11, as described above, with wall 15 adjacent the wall 102*a* of the quarter round unit. Two upper units 151 may be combined in side-by-side relation, and with two lower square units 11, as shown.

FIG. 8 shows a unit 140 of the same general construction as described in FIG. 3; however, its faceplate is in parallel sections 141 of width A, section 142 of width B, and section 143 of width C. Any may have a transparent or opaque or other distinct quality, and, as an example, rectangular section 142 is transparent, whereas sections 141 and 143 are opaque.

In FIG. 9, the modified unit 160 of the same general construction as described above, has rounded faceplate and side wall corners 161–164 at the ends of straight sides 165–168 forming a rectangle. FIG. 9 also shows a single faceplate 80 over multiple back frames whose outlines appear in broken lines.

FIG. 10 shows a multiplicity of back frame outline configurations which may be constructed for use in various combinations; and FIG. 10 is like FIG. 9 having corresponding parts 161–165. One single, intermediate, rectangular part 266 is used between 161, 162 and 165, and 163, 164 and 167 below. FIG. 10 shows the rear side of the parts, which have thin walls, as at 15 in FIG. 2. Faceplate 270 covers 161, 162, 163, and 266. Additional narrow rectangular parts 268 and 269 fit in the assembly, as shown; and faceplates 268*a* and 269*a* provide rectangular windows or openings 270 and 271 for viewing through the faceplates 268*a* and 269*a*, as for example to expose interior lettering. Faceplate 274 covers quarter round parts 163 and 164, and also part 167.

FIG. 10*a* is like FIG. 10 but shows a slide shutter 276 in window 270. FIG. 10*b* is like FIG. 9 but shows the reverse side with posts 18.

FIG. 11 shows a multiplicity of faceplate outline configurations which may be employed in various combinations in conjunction with corresponding back frame configurations. Relative edge dimensions are numbered. FIG. 12 is a representation of different forms of unit back frames with various outline configurations, which are combinable in different assemblies. See for example the assemblies in FIG. 14.

FIG. 13*a* is like FIG. 2 except that the posts 18 have their outer ends connected to faceplate 20 as by adhesive 280, such as foam plastic tape having adhesive on its opposite sides. Posts 18 are integral with backplate 14. A second faceplate 281 extends over walls 15, and it is connected to faceplate 20, as by adhesive 282.

FIG. 13*b* is the same as FIG. 13*a* except that the posts 18 are movable to selected positions relative to 14 and 20. They may be rearwardly attached to 14, as by adhesive 284. Also, plate 281 is in parallel, edge-to-edge sections 281*a*–281*e*, each adhesively attached to faceplate 20, as at 280*a*–280*e*.

FIG. 13*c* is like FIG. 13*a* but the posts have interfitting caps 289 that are attached to the posts and to faceplate 20 (faceplate 285 is not used) as by adhesive 288. FIG. 13*d* is like FIG. 13*c* but interengageable snap parts 299 and 300 are employed. Part 299 is carried by 20, and part 300 is carried by post 18.

FIG. 14 shows different or varied back frame outlines, as at 490–498 for example.

FIG. 15 is an assembly diagram showing how four back frames 313*a* and 313*b* can be assembled side-to-side to form a backplate assembly; these two rectangular sub-plates 321 are assembled to the posts 318 in the back frames 313b: then multiple narrow faceplate parts 320 are assembled onto the square faceplate to form the completed sign 340. Note also assembly of semi-circular faceplates 320*a* and the semi-circular back frames 313*a*.

FIG. 16 is a perspective view of a sign 410 having two window modules 410*a* and 410*b*. The sign includes a rectangular back frame 413 and a faceplate 420. The window modules include laterally elongated, narrow width back frames 413*a* and 413*b*, and corresponding faceplates 420*a* and 420*b* which may be transparent to provide windows. Modules 410*a* and 410*b* are assembled in side-by-side relation, 410*a* between 410 and 410*b*, as shown. An auxiliary laterally elongated faceplate 420', associated with 420, is open at 430; and a lateral slider 431 slides over the opening, between edges 432 of 420'. See arrow 434. The edges of the faceplates may be slightly (gap) spaced from their associated back frames, as referred to above.

FIG. 17 is a plan view showing the interior of a back frame 513, like the back frame 413. It has a backplate 514 and side wall 515, in rectangular form. Posts 518, like those at 218 in FIG. 3*a*, project upwardly from the backplate, and extend in rows and columns, as shown. Each horizontal row of three posts is adapted to support and connect to on horizontal modular faceplate section 520 (between lines 540 and 541, for example). Connections of the multiple faceplates 520 may be constructed as in FIG. 3*b*, for example, with connectors as shown. Note also the auxiliary upright walls 544 and 545 to support the faceplates, such walls located between columns of posts.

FIG. 18 is a section like FIG. 3*a* or 3*b* showing similar elements, but useful for a window sign somewhat like that in FIG. 16. Back frame 613 includes backplate 614 and side wall or walls 615. Posts 618 project upwardly from the backplate 614. A transverse sub-plate is seen at 621, and may be adhesively joined to the ends of posts 618, as by double (adhesive) sided "foam" tape 640. Auxiliary sub-plates are supported on and adherent to plate 621, and are indicated at 621*a* and 621*b*, there being three of the former (channel shaped), and two of the latter. They have edge-to-edge engagement at locations 645 and 645*a*. Faceplate sections 620*a* and 620*b* may be transparent, and are supported on and adherent to upwardly offset flanges on the auxiliary sub-plates, as shown, whereby hollows 646 are formed beneath the faceplate sections 620*a*, for reception of sheets bearing alphanumeric characters or letters. Likewise, a wider hollow 646*a* is formed beneath section 620*b*, for reception of a wider sheet bearing a larger alphanumeric character or characters.

FIG. 19 shows a number of different sign configurations with faceplates 720*a*–720*v*. In this group, unit 712 is like that seen in cross section in FIG. 18, with faceplate 720*r* corresponding to 620*b*, and narrower faceplates 720*s*–720*v* corresponding to 620*a* in FIG. 18. The unit measurements of the different configurations are indicated.

FIG. 20*a* shows an auxiliary plate 850 received in a recess 816 formed by a backframe 813 that includes a backplate 814 and outstanding peripheral wall or walls 815. The plate 850 may be adhesively connected at 851 to the backplate 814. Plate 850 integrally carries posts 818. A faceplate 820 overlies the recess and is closely bounded by the wall or walls 815. Structure is provided to interconnect the faceplate 820 and the posts, and may advantageously include male and female snap members 852 and 853, the former carried by projections 854 on the plate 820, and the latter carried by the terminal upper end portions of the post. Thus, the faceplate (which may carry sign information) is easily connected to the posts, and may be removed for replacement by another faceplate carrying other sign information.

FIG. 20(*b*) is like FIG. 20*a* and carries the same numerals; however, here the outer faceplate 820*a* lies outside the recess, and closely overlies the bounding wall 815. FIG. 20(*c*) is like FIG. 20*a* except that the faceplate 820 *c*) is now received downwardly in the recess 816, below the level of the wall outer terminal 815*a*. FIG. 20(*d*) is like FIG. 20 (*a*) except that the faceplate structure now includes multiple outer transparent faceplates 820*d* supported on and adhesively connected at 854 to channel shaped sub-plates 820*dd*. The latter carry portions 870 that are snap connected to the posts at 852 and 853. Hollows 855 between faceplates 820*d* and the sub-plates 820*dd* are adapted to protectively receive elongated sheets 856 bearing sign information, as via open ends of the hollows, prior to snap-connection of sub-plates 820*dd* to the posts. Information sheets can be removed and replaced after release of the snap-connections.

In FIGS. 21(*a*) and 21(*b*), the construction is like that in FIG. 20(*c*) except that the posts 818′ and 818″ taper toward the faceplates 820*e* and 820*f*. In FIGS. 21(*b*), the faceplate 820(*f*) is received deeply in the recess 816.

FIG. 22 shows two backframes 813 extending in side-by-side relation, with their walls 815 adjacent one another. Common elongated faceplate 820*g* extends over both walls and both backframes, and is snap connected to tapered posts 818′ associated with both backframes.

The auxiliary plate 850 may comprise a single plate or multiple plates, each carrying several posts. Such multiple auxiliary or sub-plates can then be arranged as desired in the backframe to match all or some of the snaps on the faceplate.

FIG. 23 shows a parallel sequence of auxiliary sub-plates 850*a* which are alike and connected in spaced relation by their break-away connectors 872. The sub-plates and connectors, along with posts 818, carried by the sub-plates, can be molded as a unit 873 of plastic material; and then the desired number of plates to fit in a backframe 813 can be broken off. See in FIG. 23 the broken away sub-unit 873′ of two such sub-plates, fitted into a corresponding sized backframe 813*b* in FIG. 24. Each sub-plate carries, for example, three posts, and is adhesively connected to the backframe 814.

Figure 26:
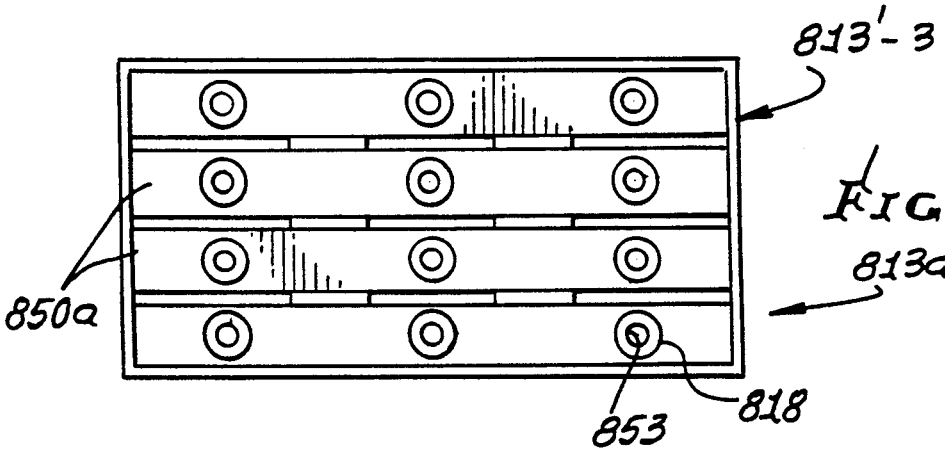
Figure 27:
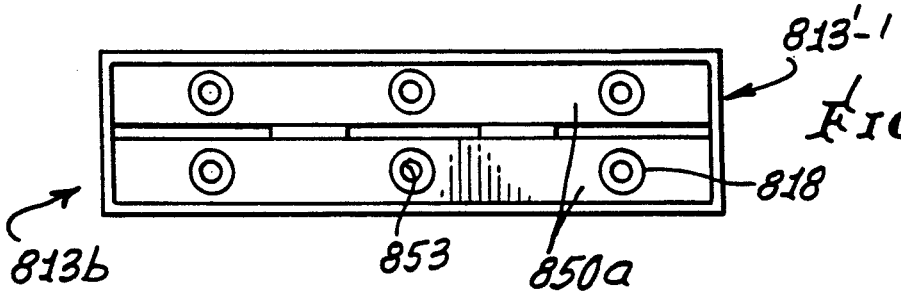
Figure 28:
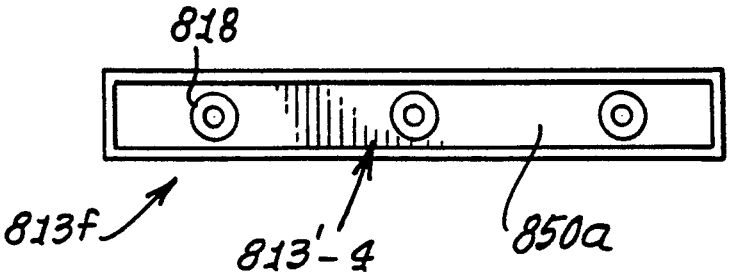
Figure 29:
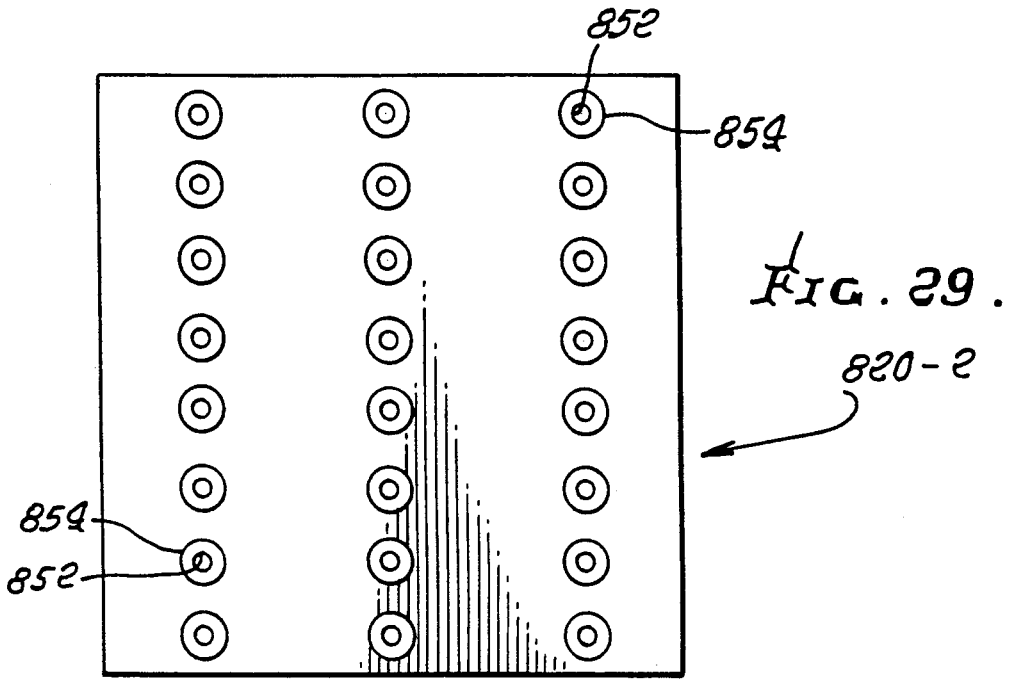
Figure 30:
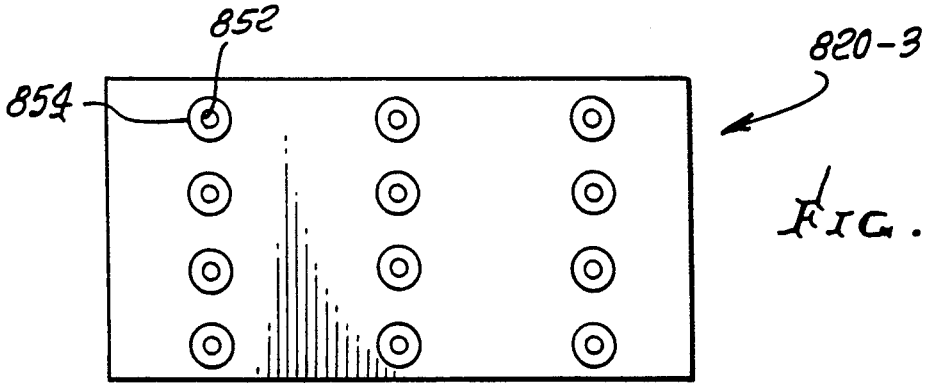
Figure 31:
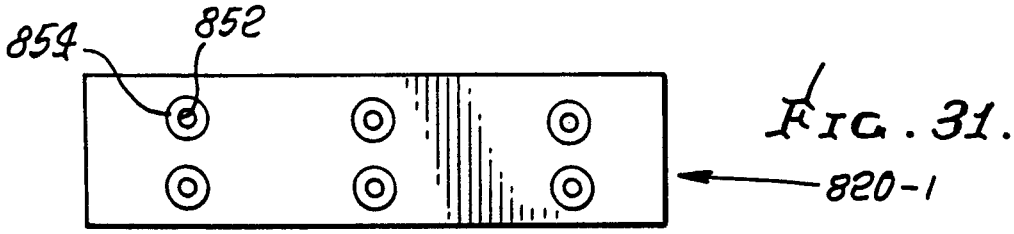
Figure 32:
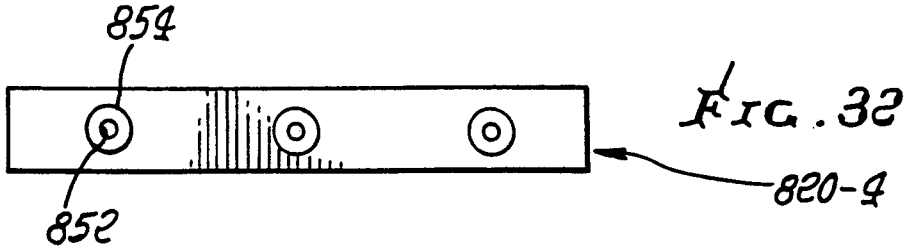

FIG. 27 is a repeat of FIG. 24, but shown in relation to other size backframes 813*c*, 813*d*, and 813*f*, into which different number of "broken off" sub-units 873′ are fitted. Note in FIG. 25 that the sub-unit 813′-2 contains eight strip-type sub-plates 850*a*; in FIG. 26 the sub-unit 813′-3 contains four sub-plates 850*a*; in FIG. 27, there are two sub-plates 850*a* in unit 813′-1; and in FIG. 28 there is one sub-plate 850*a* in unit 813′-4. Each unit peripherally interfits its corresponding backframe. Three posts 818 are integral with each sub-plate and spaced apart along its length, as shown.

FIGS. 29–32 show faceplates 820–1 to 820–4 with male snap elements 852 on supports 854 adapted to interfit female snap elements 853 on the posts 818 in FIGS. 25–28, respectively. Selected size signs can thus be easily formed and assembled.

FIG. 33 is a section showing faceplate sections 920 attached at 921 to caps 936 (corresponding to caps 236 in FIG. 3*a*). The latter carrying spring fingers 934 (male snaps) attachable to tubular posts 918 forming tapers at 935. The posts are integral with sub-plates 950 (corresponding to sub-plates 850*a* in FIG.23), with break-away connectors 972 interconnecting the sub-plates, as in FIGS. 23–27. Caps 936 are permanently attached to sections 920 at depressions 920′ in 920.

FIG. 34 is like FIG. 26 and bears the same numbers. The sides of all the enlarged diameter posts 818‴ are formed as flats 818*h*, so as not to overhang the edges 850*a*′ of the sub-plates 850*a*, allowing fitting adjacent walls 815 of the backframe. All posts are formed as described, since they may have to extend adjacent wall or walls 815, depending upon where the break-away is made, via connectors 872.

FIG. 35 shows an assembly, as in FIG. 33, with corresponding elements bearing the same numbers. The faceplate sections 920 are opaque and modular (alike). A die-cut, transparent plastic (Lexan, for example) sheet (or sheets) 981 is laminated or otherwise connected to the outer surface of one (or more) of the sections 920. The sheet (or sheets) 981 may bear sign information, as desired.

In FIG. 36, a vacuum-formed insert 1018 is employed, and has corrugated plastic sheet form, with lower flat extents 1018*a* connectible to the backplate 1014; upper flat extents 1018*b* connectible as by adhesive 1019 to the faceplate 1020, and tapered integral connections 1018*c* and 1018*d* between 1018*a* and 1018*b*, as shown. The backframe is designated at 1013.

From the above, it will be seen that an empty backframe is adapted to receive a selected number of sub-plates (inserts) sized to interfit the backframe. (See for example FIGS. 20–36). A faceplate is then selectively attachable, as via snaps, to posts on the sub-plates. The backframes may have different lengths but have the same widths to receive and interfit the sub-plates attached to the backframe or backframes. Thus, the backframes may have dimensions as follows:

EXAMPLE

| Backframe | Length | Width | # of Sub-Plates |
|---|---|---|---|
| 1 | d | d | 8 |
| 2 | ½ d | d | 4 |
| 3 | ¼ d | d | 2 |
| 4 | ⅛ d | d | 1 |

The faceplate has a size corresponding to that of the backframe.

Instead of sub-plates or posts, a thin, plastic vacuum formed, riser insert or strip may be used. It has lower flats that adhesively attach to the backframe backplate. It also has upper flats that adhesively attach to the underside of a plate structure (such as a faceplate). That structure may incorporate a window or windows for viewing sign information. The plate structure may be channel shaped to receive one or more thin display strips that carry sign information.

I claim:

1. In a modular sign system, a unit comprising, in combination, a) a back frame having a thin backplate and a thin wall outstanding from the backplate and bounding a recess formed in front of the backplate, b) support posts outstanding relative to the backplate at spaced locations in said recess, the posts having lesser height than the wall, c) and i) faceplate structure received over the recess and supported on and by the posts, the faceplate structure having a bounding edge which is adjacent said wall, said faceplate structure adapted to carry sign information, and the backplate adapted to be carried adjacent a supporting surface, d) the posts arranged in rows in said recess and attached to the backplate, the posts defining hollows opening toward the faceplate structure, and caps insertably attached to the posts, the caps and posts having flanges interengaged in said hollows to block removal of the caps from the posts, the caps projecting from the post hollows to overlie the posts outside said hollows but within said recess and present surfaces attached to the faceplate structure side facing said hollows, said faceplate structure covering all of said caps.

2. The combination of claim 1 including through openings in the backplate to receive supports for carrying the backplate as aforesaid.

3. The combination of claim 1 wherein said back frame and faceplate consist of synthetic resin.

4. The combination of claim 3 wherein said resin consists of molded plastic material.

5. The combination of claim 1 comprises multiple of said back frames extending in wall-to-wall adjacent relation, whereby said backplates define a common plane, and faceplates on said back frames to define a second common plane.

6. The combination of claim 5 wherein said wall defines a square.

7. The combination of claim 5 wherein said wall defines a segment of a circle.

8. The combination of claim 5 wherein at least one of said faceplates defines a window.

9. The combination of claim 8 including a movable shutter on a faceplate for obstructing at least part of said window.

10. The combination of claim 5 wherein said back frames include multiple rectangular backplates and multiple quarter-round backplates.

11. The combination of claim 1 wherein said wall is of uniform height and is upstanding from the periphery of the backplate.

12. The combination of claim 11 wherein said posts have uniform height and are dispersed within said recess.

13. The combination of claim 1 including said sign information on said faceplate and consisting of alphanumeric characters.

14. The combination of claim 1 including means on the backplate to attach the backplate to a support with penetration of the support.

15. The combination of claim 14 wherein said means includes a support element forming an annular groove, and a spring wire recessed in said groove and held therein by spring tension, said wire defining a pin which extends generally parallel to the backplate but projects away from the backplate for penetration into said support.

16. Multiple units as defined in claim 1 and mounted in side-by-side relation to said supporting surface.

17. The units as defined in claim 16, wherein said units have different outline configurations.

18. The units as defined in claim 16, including alphanumeric means on said unit faceplates.

19. The combination of claim 1 including alphanumeric means on said faceplate.

20. The combination of claim 1 wherein the faceplate is supported on and has connections to the posts.

21. The combination of claim 20 wherein said connections are defined by at least one of the following:

i) adhesive ii) caps iii) snaps.

22. The combination of claim 21 including an additional faceplate or plates extending over said claim 1 faceplate, and connected thereto.

23. The combination of claim 1 including sub-plate means between the faceplate and said posts, the subplate means extending parallel to the faceplate and connected thereto, and connections between the subplate means and the posts.

24. The combination of claim 23 wherein said connections include interengageable snap connection elements carried by the sub-plate means and by the posts.

25. The combination of claim 24 wherein the posts are hollow, and said snap connection elements carried by the posts define ledges within the hollow posts, and wherein the snap connection elements carried by the sub-plate means include projections in the form of spring fingers receivable into the hollow posts to progressively bend and then snap into locked interengaged relation with said ledges preventing pullout of the projections from the posts.

26. The combination of claim 25 wherein the subplate means engages the posts endwise thereof when the spring fingers are locked to the ledges.

27. The combination of claim 23 wherein the posts and connectors are arranged in rows and columns extending in spaced-apart relation.

28. The combination of claim 23 wherein said connectors are defined by one of the following:

i) snap connectors ii) adhesive connectors iii) tape connectors.

29. The combination of claim 23 wherein the subplate means includes a series of channel-shaped subplates extending in edge-to-edge relation, the faceplate overlying the sub-plate to define local hollows beneath the faceplate and areas of the subplates.

30. The combination of claim 1 wherein the faceplate defines a transparent window.

31. The combination of claim 1 including an auxiliary plate received in the recess and carried by the backframe, the posts integral with said auxiliary plate.

32. The combination of claim 31 including structure interconnecting the posts and the faceplate.

33. The combination of claim 32 wherein said structure includes at least one of the following:

adhesive snaps caps.

34. The combination of claim 31 wherein the faceplate is received in said recess.

35. The combination of claim 31 wherein the faceplate closely overlies said walls.

36. The combination of claim 31 including channel-shaped plate means interfaced between the faceplate and said post and connected thereto.

37. The combination of claim 31 wherein said posts taper toward the underside of the faceplate.

38. The combination of claim 31 including an additional backframe having an outstanding wall, at least two walls of the two backframes extending in adjacent relation, the faceplate extending closely over said two walls and over the recesses formed by the two backframes.

39. The combination of claim 31 wherein said auxiliary plate comprises multiple sub-plates each carrying one or more posts.

40. The combination of claim 1 wherein said posts comprise vacuum-formed, plastic sheet legs.

41. The combination of claim 1 wherein said posts are adjustably fitted in position in the recess, and relative to the backplate.

42. In a modular sign system, a unit comprising, in combination, a) a back frame having a thin backplate and a thin wall outstanding from the backplate and bounding a recess formed in front of the backplate, b) support posts outstanding relative to the backplate at spaced locations in said recess, the posts having lesser height than the wall, c) and one of the following:

i) a faceplate received over the recess and supported on and by the posts, the faceplate having a bounding edge which is closely bounded by said wall, ii) a faceplate received on and supported by the said wall, substantially to close the recess, said faceplate adapted to carry sign information, and the backplate adapted to be carried adjacent a supporting surface, d) an auxiliary plate received in the recess and carried by the backframe, the posts integral with said auxiliary plate, e) said auxiliary plate comprising multiple sub-plates each carrying one or more posts, f) and including fracturable break-away connectors connecting said sub-plates in side-by-side, spaced, sequential relation.

43. The combination of claim 42 wherein said sub-plates and break-away connectors consist of molded plastic material.

44. The combination of claim 43 wherein each sub-plate is elongated and at least two posts are integral therewith and spaced apart lengthwise thereof.

45. The combination of claim 44 wherein the faceplate extends over the multiple sub-plates and has releasable connections to said posts.

46. The combination of claim 42 wherein said posts have local flats at the sides thereof to fit adjacent the backframe wall when selected sub-plates are detached from other sub-plates via said break-away connectors and fitted into the backframe.

* * * * *